US006586166B1

(12) United States Patent
Olson et al.

(10) Patent No.: US 6,586,166 B1
(45) Date of Patent: Jul. 1, 2003

(54) IONIC LIQUIDS AS ADDENDA IN PHOTOTHERMOGRAPHIC SYSTEMS

(75) Inventors: Leif P. Olson, Rochester, NY (US); James H. Reynolds, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/990,730

(22) Filed: Nov. 21, 2001

(51) Int. Cl.[7] ..... G03C 1/498; G03C 7/30

(52) U.S. Cl. ..... 430/350; 502/508; 502/528; 502/543; 502/546; 502/566; 502/610; 613/614; 613/619; 613/631; 613/946

(58) Field of Search ..... 430/350, 619, 430/566, 502, 508, 528, 543, 610, 613, 614, 959, 631, 546, 946, 964

(56) References Cited

U.S. PATENT DOCUMENTS

| | | | | |
|---|---|---|---|---|
| 5,827,602 A | | 10/1998 | Koch et al. | |
| 6,037,114 A | * | 3/2000 | Hoogmartens et al. | 430/617 |
| 6,048,388 A | | 4/2000 | Schwarz | |

FOREIGN PATENT DOCUMENTS

| | | |
|---|---|---|
| WO | WO 01/25326 | 4/2001 |

* cited by examiner

*Primary Examiner*—Thorl Chea
(74) *Attorney, Agent, or Firm*—Chris P. Konkol

(57) ABSTRACT

This invention involves use of ionic liquids as addenda in a photothermographic system. The presence of an ionic liquid was found to increase image density. A preferred ionic liquid comprises an organic cation associated with a suitable anion, which ionic liquid melts at a temperature of 50° C. or less.

16 Claims, No Drawings

IONIC LIQUIDS AS ADDENDA IN PHOTOTHERMOGRAPHIC SYSTEMS

FIELD OF THE INVENTION

The present invention relates to the use of ionic liquids as addenda in photothermographic systems.

BACKGROUND OF THE INVENTION

Ionic liquids are salts characterized by their unusually low melting points, which salts can be molten even at room temperature. Ionic liquids were disclosed early on by Hurley and Wier in a series of U.S. Patents (U.S. Pat. Nos. 2,446,331, 2,446,339; 2,446,350). These patents disclosed room temperature melts, comprised of $AlCl_3$ and a variety of n-alkylpyridinium halides, which afforded an advantageous conducting bath, free of volatile solvents, for aluminum electroplating.

Over the past 15 years, work in room-temperature melts has been dominated by the use of varying proportions of $AlCl_3$ and 1-ethyl-3-methylimidazolium (EMI) chloride, as discussed in separate review articles by Wilkes and Osteryoung (Osteryoung, Robert A., (p. 329) and Wilkes, John S., (p. 217) in Molten Salt Chemistry, G. Mamantov and R. Marassi, eds., (D. Reidel Publishing, Dordrecht, Holland, 1987) and in Japanese patent Nos. 0574656 (Endo, 1993) and 0661095 (Kakazu, 1994). A disadvantage of these first molten salts, and a serious problem with any solvent-free ionic liquid containing a strong Lewis acid such as $AlCl_3$, is the liberation of toxic gas when exposed to moisture. Additionally, the highly reactive nature of Lewis acids used to form room temperature melts limits the kinds of organic and inorganic compounds which are stable in these media.

Ionic liquids typically exhibit mixed organic and inorganic character. The cation is usually a heterocyclic cation such as 1-butyl-3-methyl imidazolium or n-butylpyridinium. These organic cations, which are relatively large compared to simpler organic or inorganic cations, account for the low melting point of the salts. The anions, on the other hand, determine to a large extent the chemical properties of the system. Tetrafluoroborate and hexafluorophosphate are among the types of anions that are attracting the interest of ionic-liquid research groups. These ions do not combine with their corresponding Lewis acids and therefore are not potentially acidic. They are air and water stable.

U.S. Pat. No. 5,827,602 to Koch et al. discloses ionic liquids having improved properties for application in batteries, catalysis, chemical separations, and other uses. The ionic liquids described in Koch et al. are hydrophobic in nature, being poorly soluble in water, and contain only non-Lewis acid anions. When fluorinated, they were found to be particularly useful as inert liquid diluents for highly reactive chemicals.

Ionic liquids are discussed, for example, by Freemantle, M. *Chem. Eng. News* 1998, 76 [March 30], 32; Carmichael, H. *Chem. Britain*, 2000, [January], 36; Seddon, K. R. J. *Chem. Tech. Biotechnol.* 1997, 68,351, Welton, T. *Chem. Rev.* 1999, 99, 2071; Bruce, D. W., Bowlas, C. J., Seddon, K. R. *Chem. Comm.* 1996, 1625; Merrigan, T. L., Bates, E. D., Dorman, S. C., Davis, J. H. *Chem. Comm.* 2000, 2051; Freemantle, M. *Chem. Eng. News*, 2000, 78 [May 15], 37. See also the following reviews of ionic liquids: Holbrey, J. D.; Seddon, K. R. *Clean Products and Processes* 1999, 1, 223–236; and Dupont, J., Consorti, C. S. Spencer, J. J *Braz. Chem. Soc.* 2000, 11, 337–344.

Ionic liquids have generally been disclosed for use as solvents for a broad spectrum of chemical processes. These ionic liquids, which in some cases can serve as both catalyst and solvent, are attracting increasing interest from industry because they promise significant environmental benefits, since they are nonvolatile and therefore do not emit vapors. Hence they have been used, for example, in butene dimerization processes.

PCT publication WO 01/25326 to Lamanna et al. discloses an antistatic composition comprising at least one ionic salt consisting of a nonpolymeric nitrogen onium cation and a weakly coordinating fluoroorganic anion, the conjugate acid of the anion being a superacid, in combination with thermoplastic polymer. The composition was found to exhibit good antistatic performance over a wide range of humidity levels.

U.S. Pat. No. 6,048,388 to Schwarz et al. discloses an ink composition for inkjet printing which comprises water, a colorant and an ionic liquid material. In a preferred embodiment, the ink is substantially free of organic solvents.

In contrast to ink-jet media, such as disclosed in Schwarz et al. U.S. Pat. No. 6,048,388, photographic color images are typically obtained by a coupling reaction between the development product of an incorporated developing agent (e.g., oxidized aromatic primary amino developing agent) and a color forming compound commonly referred to as a coupler. The dyes produced by coupling are typically indoaniline, azomethine, indamine or indophenol dyes, depending upon the chemical composition of the coupler and the developing agent. In multicolor photographic elements, the subtractive process of color formation is ordinarily employed and the resulting image dyes are usually cyan, magenta and yellow dyes which are formed in or adjacent silver halide layers sensitive to radiation complementary to the radiation absorbed by the image dye, i.e. silver halide emulsions sensitive to red, green and blue radiation.

PROBLEM TO BE SOLVED BY THE INVENTION

Photothermographic systems involve heat processable photosensitive elements that are constructed so that after exposure, they can be processed in a substantially dry state by applying heat. Achieving adequate dye density and image discrimination has been a recurrent problem in photothermographic systems. Although black and white photothermographic systems, particularly in the areas of health imaging and microfiche, are commercially available, dye-forming color systems offer much greater challenges. Light-sensitive imaging elements that form color records of comparable density-forming ability and consistent stability in all color records in a photothermographic system can be difficult.

SUMMARY OF THE INVENTION

This invention involves use of ionic liquids as addenda in a color or monochrome photothermographic systems. The presence of ionic liquids in photothermographic systems has been found to provide, after processing, improvement in the amount of density and dye formed; In particular, the use of ionic liquids as addenda in the imaging layer of a photothermographic element improves the image discrimination after thermal development.

Various ionic liquids can be used in the present invention, preferably a compound comprising an organic cation and a suitable anion. Examples of anions include, for example, tetrafluoroborate, hexafluorophosphate, toluenesulfonate, methanesulfonate, or nitrate. Examples of cations include, for example, imidazolium, tetraalkylphosphonium or tetraalkylammonium cations. Many other combinations of suitable anions and cations can be used.

These and other objects are achieved in accordance with the invention which comprises a photothermographic element comprising a support having thereon at least one silver halide emulsion layer having associated therewith an ionic liquid dispersed alone or mixed with another ingredients and/or solvents.

DETAILED DESCRIPTION OF THE INVENTION

This invention involves the use of ionic liquids as photothermographic addenda to boost imaging performance such as image discrimination and, in color systems, dye formation. When ionic liquids are used as addenda at 5–50 mg/ft$^2$ with either red-sensitized, green-sensitized, or blue-sensitized photographic emulsions in a thermally processable color format, it was found that higher levels of image discrimination were seen, in a level-dependent fashion. Any suitable combination of cation and anion that does not have adverse photographic properties, yet results in an ionic liquid, can be used.

The use of ionic liquids has been found to provide more D-max, with little or no penalty in D-min. Alternately, the use of ionic liquids allows a lower processing temperature to be used.

Typically, the ionic liquid is incorporated in a silver halide emulsion prior to the emulsion being coated on a support to form a photothermographic element. Alternatively, the ionic liquid can be incorporated in a photothermographic elements adjacent the coated silver-halide emulsion wherein, during development, the ionic liquid will be available for promoting the production of development products such as reduced silver and/or oxidized color developing agent. Thus, as used herein, the term "associated therewith" signifies that the ionic liquid is in the silver halide emulsion layer or in an adjacent location where, during processing, they will come into association with the reactive components leading to silver halide development products.

Ionic liquids are defined herein as salts with melting points below about 50° C. A discussion of ionic liquids can be found in "Designer Solvents," M. Freemantle, Chemical and Engineering News (Mar. 30, 1998), the disclosure of which is hereby incorporated herein by reference in its entirety, discloses ionic liquids consisting of salts that are liquid at ambient temperatures and that can act as solvents for a broad spectrum of chemical processes and which in some cases can serve as both catalyst and solvent. Other relevant references on ionic liquids that are incorporated by reference in their entiretyinclude Holbrey, J. D.; Seddon, K. R. *Clean Products and Processes* 1999, 1, 223–236; and Dupont, J.; Consorti, C. S. Spencer, J. *J Braz. Chem. Soc.* 2000, 11, 337–344, also both.

An ionic liquid is herein defined as a non-polymeric material that in its substantially pure form is a liquid at about 50° C., preferably at about 45° C., more preferably at about 40° C., and most preferably at about 26° C. (room temperature), at about 1 atmosphere of pressure. An ionic liquid has a molecular structure comprising a cation ionically associated with an anion. Preferably, ionic liquids are low-melting non-polymeric salts that are reasonably fluid at room temperature, have negligible vapor pressure at about 25° C., and may often have a liquid range in excess of 300° C. They also have a wide range of miscibilities with organic solvents, good solvation properties, and substantial conductivity.

Structurally, ionic liquids for use in the present invention include, but are not limited to, compounds containing a heterocyclic organic cation, such as an imidazolium cation, including materials of the general formula:

(I)

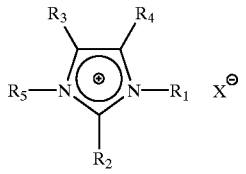

The $R_1$ through $R_5$ groups are selected to provide sufficient hydrophobicity to render the coupler non-diffusible, so that the ionic liquid remains in reactive association with the coupler with which is it co-dispersed in the dispersed phase. Non-symmetrical substitution may be optionally preferred to enhance dispersibility.

In one embodiment, in the above formula (I), $R_1$ and $R_5$ are independently an alkyl group, preferably with from 1 to 22 carbon atoms, although the number of carbon atoms can be outside of this range; $R_2$, $R_3$, and R4 each, independently of the others, are hydrogen atoms or alkyl groups, preferably with from 1 to 6 carbon atoms, more preferably with from 1 to 4 carbon atoms; and X is an anion. A preferred $R_5$ group is methyl.

Some specific examples of ionic-liquid compounds include 1-alkyl-3-methylimidazolium salts of the following formula:

IA

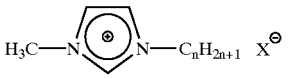

wherein n is 1 to 25. For example, a preferred ionic liquid is a 1-oleyl-3-methylimidazolium salt of the formula:

IB

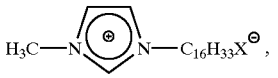

It has been found that longer chain alkyl groups (having greater than 6 carbon atoms, preferably greater than 10 carbon atoms) on at least one of the nitrogen atoms can, in some cases, improve keeping and promote the more stable formation of a hydrophobic dispersed phase for use in an imaging emulsion.

Other examples of suitable ionic liquids for use in the present invention comprise:

(a) a pyrazolium cation, including materials of the general formula:

II

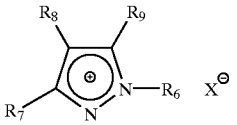

wherein $R_6$ is an alkyl group, preferably with from 1 to 18 carbon atoms, more preferably with from 1 to 12 carbon atoms, even more preferably with from 1 to 5 carbon atoms, and still more preferably with from 1 to 4 carbon atoms, although the number of carbon atoms can be outside of these ranges; $R_7$, $R_8$, and $R_9$ each, independently of the others, are hydrogen atoms or alkyl groups, preferably with from 1 to 5 carbon atoms, and more preferably with from 1 to 4 carbon atoms, and X is an anion, (b) a pyridinium cation, including materials of the general formula:

III

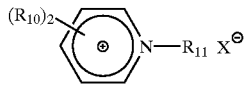

wherein $R_{11}$ is an alkyl group, preferably with from 1 to 22 carbon atoms, although the number of carbon atoms can be outside of this range; each $R_{10}$ is independently a hydrogen atom or a substituted or unsubstituted alkyl group, preferably with from 1 to 5 carbon atoms; and X is an anion. A specific example of such an ionic liquid is an N-butyl pyridinium salt of the formula:

IIIA

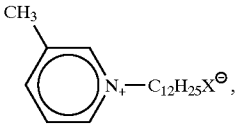

Other pyrimidinium cations can be used. For example, ionic liquids include materials of the general formulae:

IV

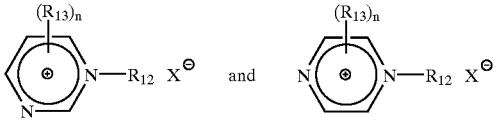

wherein $R_{12}$ is an alkyl group, preferably with from 1 to 22 carbon atoms, although the number of carbon atoms can be outside of this range; each $R_{13}$ can be independently a hydrogen atom or substituted or unsubstituted alkyl group, preferably with from 1 to 5 carbon atoms; n is 1 to 4, preferably 1 or 2; and X is an anion.

Ionic liquids can also include tetraalkyl ammonium salts and tetraalkyl phosphonium salts of the formulae:

VI

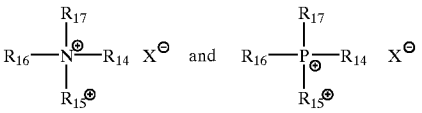

wherein $R_{14}$, $R_{15}$, $R_{16}$ and $R_{17}$ each, independently of the others, are alkyl groups, preferably with from 1 to 8 carbon atoms, although the number of carbon atoms, can be outside of this range; and X is an anion. Compounds of this formula are less likely to produce ionic liquids than the previous compounds, as will be appreciated by the skilled artisan, but some members of these classes possess ionic liquids properties similar to those of the cyclic cations.

The present invention is not limited to the particular ionic liquids mentioned above, as will be appreciated by the skilled artisan, and other structures or derivatives can be used. For example, U.S. Pat. No. 5,827,602 to Koch et al., the disclosure of which is hereby incorporated by reference in its entirety, discloses ionic liquids that are hydrophobic in nature, being poorly soluble in water, and contain only non-Lewis acid anions which may be fluorinated. Such variations in the structure of ionic liquids are encompassed by the present invention.

The organic cations, which are relatively large in ionic liquids, compared to simple organic or inorganic cations, may account for the low melting point of the ionic liquids or salts. As indicated above, any suitable photographically acceptable anion can he employed. Preferred anions often have a diffuse charge character, such as tetrafluoroborate ($BF_4$—), nitrate (NO3—), hexafluorophosphate ($PF_6$—), perchlorate ($ClO_4$—), phosphate (PO4—) and the like. Ionic liquids can also result with other anions, such as chloride, bromide, iodide, acetate, and the like.

Ionic-liquid materials, as described above, can be prepared by any desired or suitable method. For example, 1-butyl-3-methylimidazolium fluoroborate can be easily prepared in two steps. The first step is boiling commercially available 1-methylimidazole with 1-chlorobutane, followed by cooling, to obtain 1-butyl-3-methylimidazolium chloride. The second step is dissolving 1-butyl-3-methylimidazolium chloride in water and passing the solution through an ion exchange column containing a fluoroborate salt, such as sodium fluoroborate, to obtain the desired product in water. The water can later be removed by evaporation if desired. Similar preparation methods can be employed to form other ionic liquid compounds.

One preferred method for preparing ionic liquid compounds that have low solubility in water is described by Holbrey, J. D. and Seddon, K. R. (*J. Chem. Soc. Dalton Trans.* 1999, 2133). The first step is to prepare a 1-alkyl-3-methylimidazolium bromide salt by heating 1-methylimidazole with a 1-bromoalkane, followed by cooling. The resulting salt is dissolved in a suitable water-insoluble organic solvent such as dichloromethane, and agitated in the presence of an aqueous solution of the sodium salt of the desired anion, such as tetrafluoroborate ion. If the 1-alkyl group of the 1-alkyl-3-methylimidazolium cation is longer than about 5 carbons, the cation will remain in association with the dichloromethane, while the bromide ion will tend to migrate to the aqueous solution and be replaced by the tetrafluoroborate ion to maintain charge balance. This process avoids the necessity for an ion exchange column. The dichloromethane can be removed by evaporation if desired, to yield the pure 1-alkyl-3-methylimidazolium tetrafluoroborate salt.

The ionic liquid of the invention may be utilized in any that is effective to improve photothermographic image formation. Generally an amount between about 0.1 and 50 $mg/ft^2$ is suitable. A preferred amount has been found to be between about 1 and 10 mg/ft2 to provide the most effective and economical improvement in photothermographic development.

In one embodiment, when the ionic liquid material is dispersed, optionally mixed with one or more organic solvents, the oil droplet average size is in the range of 0.1 to 20 microns, more preferably 0.1 to 5 microns, and most preferably 0.1 to 1 micron. The ionic liquid material can also be in the form of solid particles at 25° C., preferably melting at the temperature of photothermographic development.

The ionic liquid of the invention may be added to any layer in the photographic element. The ionic liquid may be added as a separate blank (non-dye-forming) dispersion in pure form or mixed with other solvents or ingredients. The ionic liquid may move between layers during formation of the photothermographic element or during thermal development. Thus, the ionic liquid may be in a layer proximate or adjacent to an imaging layer instead of in the imaging layer. The ionic liquid may suitably be added, in the form of dispersion to the silver-halide emulsion during preparation prior to coating. Alternatively it may be added immediately prior to coating of the layers of the photothermographic element. A preferred place of addition of the ionic liquid has been found to be into the coupler dispersion melt prior to its being combined with the silver halide grains of the emulsion, as this provides a significant improvement with minimal effect on speed of the silver halide grains. Preferably, in the manufacture of a photothermographic element, a dual melt process is used to minimize contact time of various ingredients in the liquid state. Accordingly, prior to coating, a first melt comprising a silver-halide emulsion is mixed with a second melt comprising a mixture of (1) blocked developer dispersion, (2) coupler dispersion, (3) organic-silver-salt dispersion and (4) ionic-liquid dispersion as addenda. The mixture can further comprise melt former and other photothermographic addenda. The two melts can be combined by two pumps leading to a coating machine.

The coupler dispersion can also include an ionic liquid as disclosed in concurrently filed U.S. Pat. Ser. No. 09/990,734, hereby incorporated by reference in its entirety. Such a coupler dispersion can be formed, for example, by mixing an organic phase comprising coupler, ionic liquid, any other solvents, and a surfactant together to form a first mixture. This first mixture can then be further mixed with a second mixture comprising aqueous gelatin, to form a two-phase system or coupler dispersion comprising droplets of a non-continuous oil.

As supplemental solvents, mixed or codispersed with the ionic liquids, there can be used, for example, organic solvents, including conventional coupler solvents, including both low boiling organic solvents such as ethyl acetate, methyl ethyl ketone and methyl alcohol as described in U.S. Pat. Nos. 3,253,921 and 3,574,627 and high boiling organic solvents immiscible with water. Further, UV absorbents (which may be solid or liquid) and other photographic additives that are solid at ordinary temperature can also be mixed with the ionic liquids.

Co-dispersing oil-soluble salts (e.g. bulky hydrophobic organic-based cations with delocalized inorganic anions) can provide enhanced imaging performance. However, the charge/charge interactions of the hydrophobic cation with any anionic surfactants commonly used to make dispersions used in photothermographic systems can give rise to particles in the dispersion and subsequent coatings as well as coating problems. Thus, it may be advantageous to use, instead of anionic surfactants, non-ionic surfactants to stabilize the dispersed hydrophobic (oil) phase particles.

The use of a nonionic surfactant in combination with an ionic liquid is disclosed in commonly assigned copending U.S. Pat. Ser. No. 09/991,052, hereby incorporated by reference, which discloses that, when attempting to prepare a dispersed hydrophobic phase containing ionic liquids such as IL-1 and IL-2, unacceptable photographic dispersions may result when an anionic surfactant is used as a dispersing aid, whereas the substitution of the anionic surfactant with a nonionic surfactants as a dispersing aid often results in superior photographic dispersions.

Examples of nonionic surfactants useful in the present dispersions are disclosed in standard reference texts such as that of M. J. Rosen "Surfactants and Interfacial Phenomena", Wiley Interscience, New York, 1989. The architecture of such surfactants typically consists of a hydrophobic and hydrophilic moiety. Nonionic surfactants have no overall charge and, to distinguish them from zwitterionic surfactants, have no compensating positive and negative charge groups within the molecule. One class of nonionic surfactants is the BRIJ series manufactured by Uniqema (ICI surfactants). The hydrophobic moiety in this class consists of straight chain, saturated or unsaturated alkyl groups such lauryl, oleyl, stearyl or celtyl. The hydrophilic moiety is a short to moderate chain of repeating ethylene oxide (EO) groups. A specific example is BRIJ 58 consisting of 20 EO chain attached to a cetyl hydrophobe. A similar class of nonionic surfactants is the TRITON X series manufactured by Dow Chemical. The hydrophobic moiety for this class is an alkyl-aryl group (octyl phenyl) with the hydrophilic group being a chain of repeating ethylene oxide groups. A specific example is TRITON X-165 in which the EO is approximately 16 units. A related surfactant is OLIN10 G formerly manufactured by Olin Mathieson which has a nonyl phenyl hydrophobic group but in this case the hydrophilic group is a oligomer of approximately ten units of glycidol. Another class of surfactants is the GLUCOPON series manufactured by Henkel Corporation. The feature of this class is the use of repeating units of sugar molecules to form the hydrophilic moiety. The hydrophobe is a moderate length alkyl group. An example of this class of nonionic surfactants is GLUCOPON 225 with a short chain of one to four sugar moieties attached to a octyl or decyl group. The PLURONIC surfactants manufactured by BASF Corp uses polypropylene oxide(PO) oligomers as the hydrophobic group. This group is flanked by hydrophilic EO chains to form a branched structure. An example is PLURONIC L-44 with an estimated 10-EO chains on either side of a 23-PO chain. This architecture can be inverted to place hydrophobic groups flanking the hydrophilic group to form the PLURONIC R series. An example of this type would be PLURONTC 31R1 with 25-PO chain oligomers on either side of a 7-EO chain hydrophilic group. More elaborate architecture is available in the TETRONIC series of surfactants available from the same manufacturer. Another class of surfactants can be made by linking a hydrophobe to an oligomer of vinyl monomers containing the amido function. These have been described and utilized in commonly assigned U.S. Pat. No. 6,234,624 and copending U.S. Pat. Ser. No. 09/770,129, and U.S. Ser. No. 09/776,107, all incorporated by reference in their entirety. An example of this type of non-ionic surfactant is a dodecyl alkyl chain linked to an oligomer of 10 units of acrylamide by a sulfur atom described by the structure $C_{12}H_{25}$—S—$(CH_2CH(CONH_2))_{10}$—H. Hdrophobically capped oligomeric acrylamide dispersants useful in the present invention may be prepared by processes similar to those described in Pavia *et al, Makromol. Chem.* 1992, 193(9), 2505–2517.

A typical photothermographic color negative film construction useful in the practice of the invention is illustrated by the following element, SCN-1:

| | |
|---|---|
| SOC | Surface Overcoat |
| BU | Blue Recording Layer Unit |
| IL1 | First Interlayer |
| GU | Green Recording Layer Unit |
| IL2 | Second Interlayer |
| RU | Red Recording Layer Unit |
| AHU | Antihalation Layer Unit |
| S | Support |
| SOC | Surface Overcoat |

Details of support construction are well understood in the art. Examples of useful supports are poly(vinylacetal) film, polystyrene film, poly(ethyleneterephthalate) film, poly (ethylene naphthalate) film, polycarbonate film, and related films and resinous materials, as well as paper, cloth, glass, metal, and other supports that withstand the anticipated processing conditions. The element can contain additional layers, such as filter layers, interlayers, overcoat layers, subbing layers, antihalation layers and the like. Transparent and reflective support constructions, including subbing layers to enhance adhesion, are disclosed in Section XV of *Research Disclosure*, September 1996, Number 389, Item 38957 (hereafter referred to as ("Research Disclosure I").

The photographic elements of the invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945, and U.S. Pat. No. 4,302,523.

Each of blue, green and red recording layer units BU, GU and RU are formed of one or more hydrophilic colloid layers and contain at least one radiation-sensitive silver halide emulsion, including the developing agent and, in certain embodiments, the common dye image-forming coupler. It is preferred that the green, and red recording units are subdivided into at least two recording layer sub-units to provide increased recording latitude and reduced image granularity. In the simplest contemplated construction each of the layer units or layer sub-units consists of a single hydrophilic colloid layer containing emulsion and coupler. When coupler present in a layer unit or layer sub-unit is coated in a hydrophilic colloid layer other than an emulsion-containing layer, the coupler containing hydrophilic colloid layer is positioned to receive oxidized color developing agent from the emulsion during development. In this case, the coupler-containing layer is usually the next adjacent hydrophilic colloid layer to the emulsion-containing layer.

In order to ensure excellent image sharpness, and to facilitate manufacture and use in cameras, all of the sensitized layers are preferably positioned on a common face of the support. When in spool form, the element will be spooled such that when unspooled in a camera, exposing light strikes all of the sensitized layers before striking the face of the support carrying these layers. Further, to ensure excellent sharpness of images exposed onto the element, the total thickness of the layer units above the support should be controlled. Generally, the total thickness of the sensitized layers, interlayers and protective layers on the exposure face of the support are less than 35 $\mu$m. In another embodiment, sensitized layers disposed on two sides of a support, as in a duplitized film, can be employed.

In a preferred embodiment of this invention, the processed photographic film contains only limited amounts of color masking couplers, incorporated permanent Dmin adjusting dyes and incorporated permanent antihalation dyes. Generally, such films contain color masking couplers in total amounts up to about 0.6 mmol/m$^2$, preferably in amounts up to about 0.2 mmol/m$^2$, more preferably in amounts up to about 0.05 mmol/m$^2$, and most preferably in amounts up to about 0.01 mmol/m$^2$.

The incorporated permanent Dmin adjusting dyes are generally present in total amounts up to about 0.2 mmol/m$^2$, preferably in amounts up to about 0.1 mmol/m$^2$, more preferably in amounts up to about 0.02 mmol/m$^2$, and most preferably in amounts up to about 0.005 mmol/m$^2$.

The incorporated permanent antihalation density is up to about 0.6 in blue, green or red density, more preferably up to about 0.3 in blue, green or red density, even more preferably up to about 0.1 in blue, green or red density and most preferably up to about 0.05 in blue, green or red Status M density.

Limiting the amount of color masking couplers, permanent antihalation density and incorporated pennanent Dmin adjusting dyes serves to reduce the optical density of the films, after processing, in the 350 to 750 nm range, and thus improves the subsequent scanning and digitization of the imagewise exposed and processed films.

Overall, the limited Dmin and tone scale density enabled by controlling the quantity of incorporated color masking couplers, incorporated permanent Dmin adjusting dyes and antihalation and support optical density can serve to both limit scanning noise (which increases at high optical densities), and to improve the overall signal-to-noise characteristics of the film to be scanned. Relying on the digital correction step to provide color correction obviates the need for color masking couplers in the films.

Any convenient selection from among conventional radiation-sensitive silver halide emulsions can be incorporated within the layer units and used to provide the spectral absorptances of the invention. Most commonly high bromide emulsions containing a minor amount of iodide are employed. To realize higher rates of processing, high chloride emulsions can be employed. Radiation-sensitive silver chloride, silver bromide, silver iodobromide, silver iodochloride, silver chlorobromide, silver bromochloride, silver iodochlorobromide and silver iodobromochloride grains are all contemplated. The grains can be either regular or irregular (e.g., tabular). Tabular grain emulsions, those in which tabular grains account for at least 50 (preferably at least 70 and optimally at least 90) percent of total grain projected area are particularly advantageous for increasing speed in relation to granularity. To be considered tabular a grain requires two major parallel faces with a ratio of its equivalent circular diameter (ECD) to its thickness of at least 2. Specifically preferred tabular grain emulsions are those having a tabular grain average aspect ratio of at least 5 and, optimally, greater than 8. Preferred mean tabular grain thicknesses are less than 0.3 $\mu$m (most preferably less than 0.2 $\mu$m). Ultrathin tabular grain emulsions, those with mean tabular grain thicknesses of less than 0.07 $\mu$m, are specifically contemplated. However, in a preferred embodiment, a preponderance low reflectivity grains are preferred. By preponderance is meant that greater than 50% of the grain projected area is provided by low reflectivity silver halide grains. It is even more preferred that greater than 70% of the grain projected area be provided by low reflectivity silver halide grains. Low reflective silver halide grains are those having an average grain having a grain thickness >0.06, preferably >0.08, and more preferable >0.10 microns. The grains preferably form surface latent images so that they produce negative images when processed in a surface developer in color negative film forms of the invention.

Illustrations of conventional radiation-sensitive silver halide emulsions are provided by *Research Disclosure* I, cited above, I. Emulsion grains and their preparation. Chemical sensitization of the emulsions, which can take any conventional form, is illustrated in section IV. Chemical sensitization. Compounds useful as chemical sensitizers, include, for example, active gelatin, sulfur, selenium, tellurium, gold, platinum, palladium, iridium, osmium, rhenium, phosphorous, or combinations thereof Chemical sensitization is generally carried out at pAg levels of from 5 to 10, pH levels of from 4 to 8, and temperatures of from 30 to 80° C. Spectral sensitization and sensitizing dyes, which can take any conventional form, are illustrated by section V.

Spectral sensitization and desensitization. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol or as a dispersion of solid particles. The emulsion layers also typically include one or more antifoggants or stabilizers, which can take any conventional form, as illustrated by section VII. Antifoggants and stabilizers.

The silver halide grains to be used in the invention may be prepared according to methods known in the art, such as those described in *Research Disclosure* I, cited above, and James, The Theory of the Photographic Process. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure* I, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm, et al., U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in *Research Disclosure* Item 36736 published November 1994, here incorporated by reference.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure*, I. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers. The vehicle can be present in the emulsion in any amount useful in photographic emulsions. The emulsion can also include any of the addenda known to be useful in photographic emulsions.

While any useful quantity of light sensitive silver, as silver halide, can be employed in the elements useful in this invention, it is preferred that the total quantity be not more than 4.5 g/m$^2$ of silver, preferably less. Silver quantities of less than 4.0 g/m$^2$ are preferred, and silver quantities of less than 3.5 g/m$^2$ are even more preferred. The lower quantities of silver improve the optics of the elements, thus enabling the production of sharper pictures using the elements. These lower quantities of silver are additionally important in that they enable rapid development and desilvering of the elements. Conversely, a silver coating coverage of at least 1.0 g of coated silver per m$^2$ of support surface area in the element is necessary to realize an exposure latitude of at least 2.7 log E while maintaining an adequately low graininess position for pictures intended to be enlarged. Silver coverages in excess of 1.5 g/m$^2$ are preferred while silver coverages in excess of 2.5 g/m$^2$ are more preferred.

It is common practice to coat one, two or three separate emulsion layers within a single dye image-forming layer unit. When two or more emulsion layers are coated in a single layer unit, they are typically chosen to differ in sensitivity. When a more sensitive emulsion is coated over a less sensitive emulsion, a higher speed is realized than when the two emulsions are blended. When a less sensitive emulsion is coated over a more sensitive emulsion, a higher contrast is realized than when the two emulsions are blended. It is preferred that the most sensitive emulsion be located nearest the source of exposing radiation and the slowest emulsion be located nearest the support.

One or more of the layer units of the invention is preferably subdivided into at least two, and more preferably three or more sub-unit layers. It is preferred that all light sensitive silver halide emulsions in the color recording unit have spectral sensitivity in the same region of the visible spectrum. In this embodiment, while all silver halide emulsions incorporated in the unit have spectral absorptance according to invention, it is expected that there are minor differences in spectral absorptance properties between them. In still more preferred embodiments, the sensitizations of the slower silver halide emulsions are specifically tailored to account for the light shielding effects of the faster silver halide emulsions of the layer unit that reside above them, in order to provide an imagewise uniform spectral response by the photographic recording material as exposure varies with low to high light levels. Thus higher proportions of peak light absorbing spectral sensitizing dyes may be desirable in the slower emulsions of the subdivided layer unit to account for on-peak shielding and broadening of the underlying layer spectral sensitivity.

The interlayers IL1 and IL2 are hydrophilic colloid layers having as their primary function color contamination reduction-i.e., prevention of oxidized developing agent from migrating to an adjacent recording layer unit before reacting with dye-forming coupler. The interlayers are in part effective simply by increasing the diffusion path length that oxidized developing agent must travel. To increase the effectiveness of the interlayers to intercept oxidized developing agent, it is conventional practice to incorporate oxidized developing agent. Antistain agents (oxidized developing agent scavengers) can be selected from among those disclosed by *Research Disclosure* I, X. Dye image formers and modifiers, D. Hue modifiers/stabilization, paragraph (2). When one or more silver halide emulsions in GU and RU are high bromide emulsions and, hence have significant native sensitivity to blue light, it is preferred to incorporate a yellow filter, such as Carey Lea silver or a yellow processing solution decolorizable dye, in IL 1. Suitable yellow filter dyes can be selected from among those illustrated by *Research Disclosure* I, Section VIII. Absorbing and scattering materials, B. Absorbing materials. In elements of the instant invention, magenta colored filter materials are absent from IL2 and RU.

The antihalation layer unit AHU typically contains a processing solution removable or decolorizable light absorbing material, such as one or a combination of pigments and dyes. Suitable materials can be selected from among those disclosed in *Research Disclosure* I, Section VIII. Absorbing materials. A common alternative location for AHU is between the support S and the recording layer unit coated nearest the support.

The surface overcoats SOC are hydrophilic colloid layers that are provided for physical protection of the color negative elements during handling and processing. Each SOC also provides a convenient location for incorporation of addenda that are most effective at or near the surface of the color negative element. In some instances the surface overcoat is divided into a surface layer and an interlayer, the latter functioning as spacer between the addenda in the surface layer and the adjacent recording layer unit. In another common variant form, addenda are distributed between the surface layer and the interlayer, with the latter containing addenda that are compatible with the adjacent recording layer unit. Most typically the SOC contains addenda, such as coating aids, plasticizers and lubricants, antistats and matting agents, such as illustrated by *Research Disclosure* I, Section IX. Coating physical property modifying addenda. The SOC overlying the emulsion layers additionally preferably contains an ultraviolet absorber, such as illustrated by *Research Disclosure* I, Section VI. UV dyes/optical brighteners/luminescent dyes, paragraph (1).

Instead of the layer unit sequence of element SCN-1, alternative layer units sequences can be employed and are particularly attractive for some emulsion choices. Using high chloride emulsions and/or thin (<0.2 $\mu$m mean grain thickness) tabular grain emulsions all possible interchanges of the positions of BU, GU and RU can be undertaken without risk of blue light contamination of the minus blue records, since these emulsions exhibit negligible native sensitivity in the visible spectrum. For the same reason, it is unnecessary to incorporate blue light absorbers in the interlayers.

When the emulsion layers within a dye image-forming layer unit differ in speed, it is conventional practice to limit the incorporation of dye image-forming coupler in the layer of highest speed to less than a stoichiometric amount, based on silver. The function of the highest speed emulsion layer is to create the portion of the characteristic curve just above the minimum density-i.e., in an exposure region that is below the threshold sensitivity of the remaining emulsion layer or layers in the layer unit. In this way, adding the increased granularity of the highest sensitivity speed emulsion layer to the dye image record produced is minimized without sacrificing imaging speed.

In the foregoing discussion the blue, green and red recording layer units are described as containing developing agents for producing yellow, magenta and cyan dyes, respectively, as is conventional practice in color negative elements used for printing. The invention can be suitably applied to conventional color negative construction as illustrated. Color reversal film construction would take a similar form, with the exception that colored masking couplers would be completely absent; in typical forms, development inhibitor releasing couplers would also be absent. In preferred embodiments, the color negative elements are intended exclusively for scanning to produce three separate electronic color records. Thus the actual hue of the image dye produced is of no importance. What is essential is merely that the dye image produced in each of the layer units be differentiable from that produced by each of the remaining layer units. To provide this capability of differentiation it is contemplated that each of the layer units contain one or more dye image-forming couplers chosen to produce image dye having an absorption half-peak bandwidth lying in a different spectral region. It is immaterial whether the blue, green or red recording layer unit forms a yellow, magenta or cyan dye having an absorption half peak bandwidth in the blue, green or red region of the spectrum, as is conventional in a color negative element intended for use in printing, or an absorption half-peak bandwidth in any other convenient region of the spectrum, ranging from the near ultraviolet (300–400 nm) through the visible and through the near infrared (700–1200 nm), so long as the absorption half-peak bandwidths of the image dye in the layer units extend over substantially non-coextensive wavelength ranges. The term "substantially non-coextensive wavelength ranges" means that each image dye exhibits an absorption half-peak band width that extends over at least a 25 (preferably 50) nm spectral region that is not occupied by an absorption half-peak band width of another image dye. Ideally the image dyes exhibit absorption half-peak band widths that are mutually exclusive.

When a layer unit contains two or more emulsion layers differing in speed, it is possible to lower image granularity in the image to be viewed, recreated from an electronic record, by forming in each emulsion layer of the layer unit a dye image which exhibits an absorption half-peak band width that lies in a different spectral region than the dye images of the other emulsion layers of layer unit. This technique is particularly well suited to elements in which the layer units are divided into sub-units that differ in speed. This allows multiple electronic records to be created for each layer unit, corresponding to the differing dye images formed by the emulsion layers of the same spectral sensitivity. The digital record formed by scanning the dye image formed by an emulsion layer of the highest speed is used to recreate the portion of the dye image to be viewed lying just above minimum density. At higher exposure levels second and, optionally, third electronic records can be formed by scanning spectrally differentiated dye images formed by the remaining emulsion layer or layers. These digital records contain less noise (lower granularity) and can be used in recreating the image to be viewed over exposure ranges above the threshold exposure level of the slower emulsion layers. This technique for lowering granularity is disclosed in greater detail by Sutton U.S. Pat. No. 5,314,794, the disclosure of which is here incorporated by reference.

Each layer unit of the color negative elements of the invention produces a dye image characteristic curve gamma of less than 1.5, which facilitates obtaining an exposure latitude of at least 2.7 log E. A minimum acceptable exposure latitude of a multicolor photographic element is that which allows accurately recording the most extreme whites (e.g., a bride's wedding gown) and the most extreme blacks (e.g., a bride groomt's tuxedo) that are likely to arise in photographic use. An exposure latitude of 2.6 log E can just accommodate the typical bride and groom wedding scene. An exposure latitude of at least 3.0 log E is preferred, since this allows for a comfortable margin of error in exposure level selection by a photographer. Even larger exposure latitudes are specifically preferred, since the ability to obtain accurate image reproduction with larger exposure errors is realized. Whereas in color negative elements intended for printing, the visual attractiveness of the printed scene is often lost when gamma is exceptionally low, when color negative elements are scanned to create digital dye image records, contrast can be increased by adjustment of the electronic signal information. When the elements of the invention are scanned using a reflected beam, the beam travels through the layer units twice. This effectively doubles gamma (ΔD÷Δlog E) by doubling changes in density (ΔD). Thus, gamma's as low as 1.0 or even 0.6 are contemplated and exposure latitudes of up to about 5.0 log E or higher are feasible. Gammas above 0.25 are preferred and gammas above 0.30 are more preferred. Gammas of between about 0.4 and 0.5 are especially preferred.

In a preferred embodiment the dye image is formed by the use of an incorporated developing agent, in reactive association with each color layer. More preferably, the incorporated developing agent is a blocked developing agent.

Examples of blocking groups that can be used in photographic elements of the present invention include, but are not limited to, the blocking groups described in U.S. Pat. No. 3,342,599, to Reeves; *Research Disclosure* (129 (1975) pp. 27–30) published by Kenneth Mason Publications, Ltd., Dudley Annex, 12a North Street, Emsworth, Hampshire P010 7DQ, ENGLAND; U.S. Pat. No. 4,157,915, to Hamaoka et al., U.S. Pat. No. 4, 060,418, to Waxman and Mourning; and in U.S. Pat. No. 5,019,492. Other examples of blocking groups that can be used in photographic elements of the present invention include, but are not limited to, the blocking groups described in U.S. Pat. No. 3,342,599, to Reeves, *Research Disclosure* (129 (1975) pp. 27–30) published by Kenneth Mason Publications, Ltd., Dudley Annex, 12a North Street, Emsworth, Hampshire P010 7DQ, ENGLAND, U.S. Pat. No. 4,157,915, to Hamaoka et al.; U.S. Pat. No. 4,060,418, to Waxman and Mourning; and in U.S. Pat. No. 5,019,492. Particularly useful are those blocking groups described in U.S. Application Ser. No. 09/476,234, filed Dec. 30, 1999, IMAGING ELEMENT CONTAINING A BLOCKED PHOTOGRAPICALLY USEFUL COMPOUND; U.S. application Ser. No. 09/475,691, filed Dec. 30, 1999, IMAGING ELEMENT CONTAINING A BLOCKED PHOTOGRAPHICALLY USEFUL COMPOUND; U.S. application Ser. No. 09/475,703, filed Dec. 30, 1999, IMAGING ELEMENT CONTAINING A BLOCKED PHOTOGRAPHICALLY USEFUL COMPOUND; U.S. application Ser. No. 09/475,690, filed Dec. 30,1999, IMAGING ELEMENT CONTAINING A BLOCKED PHOTOGRAPHICALLY USEFUL COMPOUND, and U.S. application Ser. No. 09/476,233, filed Dec. 30, 1999, PHOTOGRAPHIC OR PHOTOTHERMOGRAPHIC ELEMENT CONTAINING A BLOCKED PHOTOGRAPHICALLY USEFUL COMPOUND. In one embodiment of the invention, the blocked developer may be represented by the following Structure I:

I $$\text{DEV-(LINK 1)}_1\text{-(TIME)}_m\text{-(LINK 2)}_n\text{-B}$$

wherein,

DEV is a silver-halide color developing agent according to the present invention;

LINK 1 and LINK 2 are linking groups;

TIME is a timing group;

1 is 0 or 1;

m is 0, 1, or 2;

n is 0 or 1;

1+n is 1 or 2;

B is a blocking group or B is:

$$\text{—B'—(LINK 2)}_n\text{—(TIME)}_m\text{—(LINK 1)}_1\text{—DEV}$$

wherein B' also blocks a second developing agent DEV.

In a preferred embodiment of the invention, LINK 1 or LINK 2 are of structure II:

II

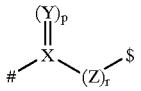

wherein

X represents carbon or sulfur;

Y represents oxygen, sulfur of N—$R_1$, where $R_1$ is substituted or unsubstituted alkyl or substituted or unsubstituted aryl;

p is 1 or 2;

Z represents carbon, oxygen or sulfur;

r is 0 or 1; with the proviso that when X is carbon, both p and r are 1, when X is sulfur, Y is oxygen, p is 2 and r is 0;

# denotes the bond to PUG (for LINK 1) or TIME (for LINK 2):

$ denotes the bond to TIME (for LINK 1) or $T_{(t)}$ substituted carbon (for LINK 2).

Illustrative linking groups include, for example,

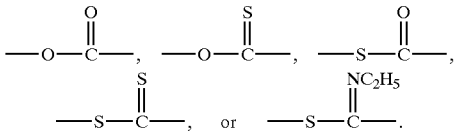

TIME is a timing group. Such groups are well-known in the art such as (1) groups utilizing an aromatic nucleophilic substitution reaction as disclosed in U.S. Pat. No. 5,262,291; (2) groups utilizing the cleavage reaction of a hemiacetal (U.S. Pat. No. 4,146,396, Japanese Applications 60–249148; 60–249149); (3) groups utilizing an electron transfer reaction along a conjugated system (U.S. Pat. No. 4,409,323; 4,421,845, Japanese Applications 57–188035; 58–98728; 58–209736; 58–209738); and (4) groups using an intramolecular nucleophilic substitution reaction (U.S. Pat. No. 4,248,962).

A number of modifications of color negative elements have been suggested for accommodating scanning, as illustrated by *Research Disclosure* I, Section XIV. Scan facilitating features. These systems to the extent compatible with the color negative element constructions described above are contemplated for use in the practice of this invention.

It is also contemplated that the imaging element of this invention may be used with non-conventional sensitization schemes. For example, instead of using imaging layers sensitized to the red, green, and blue regions of the spectrum, the light-sensitive material may have one white-sensitive layer to record scene luminance, and two color-sensitive layers to record scene chrominance. Following development, the resulting image can be scanned and digitally reprocessed to reconstruct the full colors of the original scene as described in U.S. Pat. No. 5,962,205. The imaging element may also comprise apan-sensitized emulsion with accompanying color-separation exposure. In this embodiment, the developers of the invention would give rise to a colored or neutral image that, in conjunction with the separation exposure, would enable full recovery of the original scene color values. In such an element, the image may be formed by either developed silver density, a combination of one or more conventional couplers, or "black" couplers such as resorcinol couplers. The separation exposure may be made either sequentially through appropriate filters, or simultaneously through a system of spatially discreet filter elements (commonly called a "color filter array").

The imaging element of the invention may also be a black and white image-forming material comprised, for example, of a pan-sensitized silver halide emulsion and a developer of the invention. In this embodiment, the image may be formed by developed silver density following processing, or by a coupler that generates a dye which can be used to carry the neutral image tone scale.

When conventional yellow, magenta, and cyan image dyes are formed to read out the recorded scene exposures following chemical development of conventional exposed color photographic materials, the response of the red, green, and blue color recording units of the element can be accurately discerned by examining their densities. Densitometry is the measurement of transmitted light by a sample using selected colored filters to separate the imagewise response of the RGB image dye forming units into relatively independent channels. It is common to use Status M filters to gauge the response of color negative film elements intended for optical printing, and Status A filters for color reversal films intended for direct transmission viewing. In integral densitometry, the unwanted side and tail absorptions of the imperfect image dyes leads to a small amount of channel mixing, where part of the total response of, for example, a magenta channel may come from off-peak absorptions of either the yellow or cyan image dyes records, or both, in neutral characteristic curves. Such artifacts may be negligible in the measurement of a film's spectral sensitivity. By appropriate mathematical treatment of the integral density response, these unwanted off-peak density contributions can be completely corrected providing analytical densities, where the response of a given color record is independent of the spectral contributions of the other image dyes. Analytical density determination has been summarized in the SPSE Handbook of photographic Science and Engineering, W. Thomas, editor, John Wiley and Sons, New York, 1973, Section 15.3, Color Densitometry, pp. 840–848.

Image noise can be reduced, where the images are obtained by scanning exposed and processed color negative film elements to obtain a manipulatable electronic record of the image pattern, followed by reconversion of the adjusted electronic record to a viewable form. Image sharpness and colorfulness can be increased by designing layer gamma ratios to be within a narrow range while avoiding or minimizing other performance deficiencies, where the color record is placed in an electronic form prior to recreating a color image to be viewed. Whereas it is impossible to separate image noise from the remainder of the image information, either in printing or by manipulating an electronic image record, it is possible by adjusting an electronic image record that exhibits low noise, as is provided by color negative film elements with low gamma ratios, to improve overall curve shape and sharpness characteristics in a manner that is impossible to achieve by known printing techniques. Thus, images can be recreated from electronic image records derived from such color negative elements that are superior to those similarly derived from conventional color negative elements constructed to serve optical printing applications. The excellent imaging characteristics of the described element are obtained when the gamma ratio for each of the red, green and blue color recording units is less than 1.2. In a more preferred embodiment, the red, green, and blue light sensitive color forming units each exhibit gamma ratios of less than 1.15. In an even more preferred embodiment, the red and blue light sensitive color forming units each exhibit gamma ratios of less than 1.10. In a most preferred embodiment, the red, green, and blue light sensitive color forming units each exhibit gamma ratios of less than 1.10. In all cases, it is preferred that the individual color unit(s) exhibit gamma ratios of less than 1.15, more preferred that they exhibit gamma ratios of less than 1.10 and even more preferred that they exhibit gamma ratios of less than 1.05. In a like vein, it is preferred that the gamma ratios be greater than 0.8, more preferred that they be greater than 0.85 and most preferred that they be greater than 0.9. The gamma ratios of the layer units need not be equal. These low values of the gamma ratio are indicative of low levels of interlayer interaction, also known as interlayer interimage effects, between the layer units and are believed to account for the improved quality of the images after scanning and electronic manipulation. The apparently deleterious image characteristics that result from chemical interactions between the layer units need not be electronically suppressed during the image manipulation activity. The interactions are often difficult if not impossible to suppress properly using known electronic image manipulation schemes.

Elements having excellent light sensitivity are best employed in the practice of this invention. The elements should have a sensitivity of at least about ISO 50, preferably have a sensitivity of at least about ISO 100, and more preferably have a sensitivity of at least about ISO 200. Elements having a sensitivity of up to ISO 3200 or even higher are specifically contemplated. The speed, or sensitivity, of a color negative photographic element is inversely related to the exposure required to enable the attainment of a specified density above fog after processing. Photographic speed for a color negative element with a gamma of about 0.65 in each color record has been specifically defined by the American National Standards Institute (ANSI) as ANSI Standard Number PH 2.27–1981 (ISO (ASA Speed)) and relates specifically the average of exposure levels required to produce a density of 0.15 above the minimum density in each of the green light sensitive and least sensitive color recording unit of a color film. This definition conforms to the International Standards Organization (ISO) film speed rating. For the purposes of this application, if the color unit gammas differ from 0.65, the ASA or ISO speed is to be calculated by linearly amplifying or deamplifying the gamma vs. log E (exposure) curve to a value of 0.65 before determining the speed in the otherwise defined manner.

The present invention also contemplates the use of photothermographic elements of the present invention in what are often referred to as single use cameras (or "film with lens" units). These cameras are sold with film preloaded in them and the entire camera is returned to a processor with the exposed film remaining inside the camera. The one-time-use cameras employed in this invention can be any of those known in the art. These cameras can provide specific features as known in the art such as shutter means, film winding means, film advance means, waterproof housings, single or multiple lenses, lens selection means, variable aperture, focus or focal length lenses, means for monitoring lighting conditions, means for adjusting shutter times or lens characteristics based on lighting conditions or user provided instructions, and means for camera recording use conditions directly on the film. These features include, but are not limited to: providing simplified mechanisms for manually or automatically advancing film and resetting shutters as described at Skanman, U.S. Pat. 4,226,517; providing apparatus for automatic exposure control as described at Matterson et al, U S. Pat. No. 4,345,835; moisture-proofing as described at Fujimura et al, U.S. Pat. No. 4,766,451; providing internal and external film casings as described at Ohmura et al, U.S. Pat. No. 4,751,536; providing means for recording use conditions on the film as described at Taniguchi et al, U.S. Pat. No. 4,780,735; providing lens fitted cameras as described at Arai, U.S. Pat. No. 4,804,987; providing film supports with superior anti-curl properties as described at Sasaki et al, U.S. Pat. No. 4,827,298; providing a viewfinder as described at Ohmura et al, U.S. Pat. No. 4,812,863; providing a lens of defined focal length and lens speed as described at Ushiro et al, U.S. Pat. No. 4,812,866; providing multiple film containers as described at Nakayama et al, U.S. Pat. No. 4,831,398 and at Ohmura et al, U.S. Pat. No. 4,833,495; providing films with improved anti-friction characteristics as described at Shiba, U.S. Pat. No. 4,866,469; providing winding mechanisms, rotating spools, or resilient sleeves as described at Mochida, U.S. Pat. No. 4,884,087; providing a film patrone or cartridge removable in an axial direction as described by Takei et al at U.S. Patents 4,890,130 and 5,063,400; providing an electronic flash means as described at Ohmura et al, U.S. Pat. No. 4,896,178; providing an externally operable member for effecting exposure as described at Mochida et al, U.S. Pat. No. 4,954,857; providing film support with modified sprocket holes and means for advancing said film as described at Murakami, U.S. Pat. No. 5,049,908; providing internal mirrors as described at Hara, U.S. Pat. No. 5,084,719; and providing silver halide emulsions suitable for use on tightly wound spools as described at Yagi et al, European Patent Application 0,466,417 A.

While the film may be mounted in the one-time-use camera in any manner known in the art, it is especially preferred to mount the film in the one-time-use camera such that it is taken up on exposure by a thrust cartridge. Thrust cartridges are disclosed by Kataoka et al U.S. Pat. No. 5,226,613; by Zander U.S. Pat. No. 5,200,777; by Dowling et al U.S. Pat. No. 5,031,852; and by Robertson et al U.S. Pat. No. 4,834,306. Narrow bodied one-time-use cameras suitable for employing thrust cartridges in this way are described by Tobioka et al U.S. Pat. No. 5,692,221.

Cameras may contain a built-in processing capability, for example a heating element. Designs for such cameras including their use in an image capture and display system are disclosed in Stoebe, et al., U.S. patent application Ser. No. 09/388,573 filed Sep. 1, 1999, incorporated herein by reference. The use of a one-time use camera as disclosed in said application is particularly preferred in the practice of this invention.

Photographic elements of the present invention are preferably imagewise exposed using any of the known techniques, including those described in *Research Disclosure* I, Section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like). The photothermographic elements are also exposed by means of various forms of energy, including ultraviolet and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide.

The elements as discussed above may serve as origination material for some or all of the following processes: image scanning to produce an electronic rendition of the capture image, and subsequent digital processing of that rendition to manipulate, store, transmit, output, or display electronically that image.

As mentioned above, the photographic elements of the present invention can be photothermographic elements of the type described in *Research Disclosure* 17029 are included by reference. The photothermographic elements may be of type A or type B as disclosed in *Research Disclosure* I. Type A elements contain in reactive association a photosensitive silver halide, a reducing agent or developer, an activator, and a coating vehicle or binder. In these systems development occurs by reduction of silver ions in the photosensitive silver halide to metallic silver. Type B systems can contain all of the elements of a type A system in addition to a salt or complex of an organic compound with silver ion. In these systems, this organic complex is reduced during development to yield silver metal. The organic silver salt will be referred to as the silver donor. References describing such imaging elements include, for example, U.S. Pat. Nos. 3,457,075; 4,459,350; 4,264,725 and 4,741,992.

A photothermographic element comprises a photosensitive component that consists essentially of photographic silver halide. In the type B photothermographic material it is believed that the latent image silver from the silver halide acts as a catalyst for the described image-forming combination upon processing. In these systems, a preferred concentration of photographic silver halide is within the range of 0.01 to 100 moles of photographic silver halide per mole of silver donor in the photothermographic material.

The Type B photothermographic element comprises an oxidation-reduction image forming combination that contains an organic silver salt oxidizing agent. The organic silver salt is a silver salt which is comparatively stable to light, but aids in the formation of a silver image when heated to 80° C. or higher in the presence of an exposed photocatalyst (i.e., the photosensitive silver halide) and a reducing agent.

Suitable organic silver salts include silver salts of organic compounds having a carboxyl group. Preferred examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laureate, silver caprate, silver myristate, silver palmitate, silver maleate, silver fumarate, silver tartarate, silver furoate, silver linoleate, silver butyrate and silver camphorate, mixtures thereof, etc. Silver salts which are substitutable with a halogen atom or a hydroxyl group can also be effectively used. Preferred examples of the silver salts of aromatic carboxylic acid and other carboxyl group-containing compounds include silver benzoate, a silver-substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellilate, a silver salt of 3-carboxymethyl-4-methyl-4-thiazoline-2-thione or the like as described in U.S. Pat. No. 3,785,830, and silver salt of an aliphatic carboxylic acid containing a thioether group as described in U.S. Pat. No. 3,330,663.

Furthermore, a silver salt of a compound containing an imino group can be used. Preferred examples of these compounds include a silver salt of benzotriazole and a derivative thereof as described in Japanese patent publications 30270/69 and 18146/70, for example a silver salt of benzotriazole or methylbenzotriazole, etc., a silver salt of a halogen substituted benzotriazole, such as a silver salt of 5-chlorobenzotriazole, etc., a silver salt of 1,2,4-triazole, a silver salt of 3-amino-5-mercaptobenzyl-1,2,4-triazole, of 1H-tetrazole as described in U.S. Pat. No. 4,220,709, a silver salt of imidazole and an imidazole derivative, and the like.

A second silver salt with a fog inhibiting property may also be used. The second silver organic salt, or thermal fog inhibitor, according to the present invention include silver salts of thiol or thione substituted compounds having a heterocyclic nucleus containing 5 or 6 ring atoms, at least one of which is nitrogen, with other ring atoms including carbon and up to two hetero-atoms selected from among oxygen, sulfur and nitrogen are specifically contemplated. Typical preferred heterocyclic nuclei include triazole, oxazole, thiazole, thiazoline, imidazoline, imidazole, diazole, pyridine and triazine. Preferred examples of these heterocyclic compounds include a silver salt of 2-mercaptobenzimidazole, a silver salt of 2-mercapto-5-aminothiadiazole, a silver salt of 5-carboxylic-1-methyl-2-phenyl-4-thiopyridine, a silver salt of mercaptotriazine, a silver salt of 2-mercaptobenzoxazole.

The second organic silver salt may be a derivative of a thionamide. Specific examples would include but not be limited to the silver salts of 6-chloro-2-mercapto benzothiazole, 2-mercapto-thiazole, naptho(1,2-d)thiazole-2(1H)-thione,4-methyl-4-thiazoline-2-thione, 2-thiazolidinethione, 4,5-dimethyl 4-thiazoline-2-thione, 4-methyl-5-carboxy-4-thiazoline-2-thione, and 3-(2-carboxyethyl)-4-methyl-4-thiazoline-2-thione.

Preferably, the second organic silver salt is a derivative of a mercapto-triazole. Specific examples would include, but not be limited to, a silver salt of 3-mercapto-4-phenyl- 1,2,4 triazole and a silver salt of 3-mercapto- 1,2,4-triazole.

Most preferably the second organic salt is a derivative of a mercapto-tetrazole. In one preferred embodiment, a mercapto tetrazole compound useful in the present invention is represented by the following structure VI:

VI

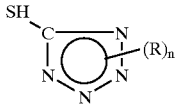

wherein n is 0 or 1, and R is independently selected from the group consisting of substituted or unsubstituted alkyl, aralkyl, or aryl. Substituents include, but are not limited to, C1 to C6 alkyl, nitro, halogen, and the like, which substituents do not adversely affect the thermal fog inhibiting effect of the silver salt. Preferably, n is 1 and R is an alkyl having 1 to 6 carbon atoms or a substituted or unsubstituted phenyl group. Specific examples include but are not limited to silver salts of 1-phenyl-5-mercapto-tetrazole, 1-(3-acetamido)-5-mercapto-tetrazole, or 1-[3-(2-sulfo)benzamidophenyl]-5-mercapto-tetrazole.

The photosensitive silver halide grains and the organic silver salt are coated so that they are in catalytic proximity during development. They can be coated in contiguous layers, but are preferably mixed prior to coating. Conventional mixing techniques are illustrated by Research Disclosure, Item 17029, cited above, as well as U.S. Pat. No. 3,700,458 and published Japanese patent applications Nos. 32928/75, 13224/74, 17216/75 and 42729/76.

The photothermographic element can comprise a thermal solvent. Examples of useful thermal solvents. Examples of thermal solvents, for example, salicylanilide, phthalimide, N-hydroxyphthalimide, N-potassium-phthalimide, succinimide, N-hydroxy-1,8-naphthalimide, phthalazine, 1-(2H)-phthalazinone, 2-acetylphthalazinone, benzanilide, and benzenesulfonamide. Prior-art thermal solvents are disclosed, for example, in U.S. Pat. No. 6,013,420 to Windender. Examples of toning agents and toning agent combinations are described in, for example, Research Disclosure, June 1978, Item No. 17029 and U.S. Pat. No. 4,123,282.

Photothermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in Research Disclosure, December 1978, Item No. 17643 and Research Disclosure, June 1978, Item No. 17029.

After imagewise exposure of a photothermographic element, the resulting latent image can be developed in a variety of ways. The simplest is by overall heating the element to thermal processing temperature. This overall heating merely involves heating the photothermographic element to a temperature within the range of about 90° C. to about 180° C. until a developed image is formed, such as within about 0.5 to about 60 seconds. By increasing or decreasing the thermal processing temperature a shorter or longer time of processing is useful. A preferred thermal processing temperature is within the range of about 100° C. to about 160° C. Heating means known in the photothermographic arts are useful for providing the desired processing temperature for the exposed photothermographic element. The heating means is, for example, a simple hot plate, iron, roller, heated drum, microwave heating means, heated air, vapor or the like.

It is contemplated that the design of the.processor for the photothermographic element be linked to the design of the cassette or cartridge used for storage and use of the element. Further, data stored on the film or cartridge may be used to modify processing conditions or scanning of the element. Methods for accomplishing these steps in the imaging system are disclosed by Stoebe, et al., U.S. Pat. No. 6,062,746 and Szajewski, et al., U.S. Pat. No. 6,048,110, commonly assigned, which are incorporated herein by reference. The use of an apparatus whereby the processor can be used to write information onto the element, information which can be used to adjust processing, scanning, and image display is also envisaged. This system is disclosed in now allowed Stoebe, et al., U.S. Patent Applications Ser. Nos. 09/206,914 filed Dec. 7, 1998 and 09/333,092 filed Jun. 15, 1999, which are incorporated herein by reference.

Thermal processing is preferably carried out under ambient conditions of pressure and humidity. Conditions outside of normal atmospheric pressure and humidity are useful.

The components of the photothermographic element can be in any location in the element that provides the desired image. If desired, one or more of the components can be in one or more layers of the element. For example, in some cases, it is desirable to include certain percentages of the reducing agent, toner, stabilizer and/or other addenda in the overcoat layer over the photothermographic image recording layer of the element. This, in some cases, reduces migration of certain addenda in the layers of the element.

In view of advances in the art of scanning technologies, it has now become natural and practical for photothermographic color films such as disclosed in EP 0762 201 to be scanned, which can be accomplished without the necessity of removing the silver or silver-halide from the negative, although special arrangements for such scanning can be made to improve its quality. See, for example, Simmons U.S. Pat. No. 5,391,443.

Nevertheless, the retained silver halide can scatter light, decrease sharpness and raise the overall density of the film thus leading to impaired scanning. Further, retained silver halide can printout to ambient/viewing/scanning light, render non-imagewise density, degrade signal-to noise of the original scene, and raise density even higher. Finally, the retained silver halide and organic silver salt can remain in reactive association with the other film chemistry, making the film unsuitable as an archival media. Removal or stabilization of these silver sources are necessary to render the PTG film to an archival state.

Furthermore, the silver coated in the PTG film (silver halide, silver donor, and metallic silver) is unnecessary to the dye image produced, and this silver is valuable and the desire is to recover it is high.

Thus, it may be desirable to remove, in subsequent processing steps, one or more of the silver containing components of the film: the silver halide, one or more silver donors, the silver-containing thermal fog inhibitor if present, and/or the silver metal. The three main sources are the developed metallic silver, the silver halide, and the silver donor. Alternately, it may be desirable to stabilize the silver halide in the photothermographic film. Silver can be wholly or partially stabilized/removed based on the total quantity of silver and/or the source of silver in the film.

The removal of the silver halide and silver donor can be accomplished with a common fixing chemical as known in the photographic arts. Specific examples of useful chemicals include: thioethers, thioureas, thiols, thiones, thionamides, amines, quaternary amine salts, ureas, thiosulfates, thiocyanates, bisulfites, amine oxides, iminodiethanol -sulfur dioxide addition complexex, amphoteric amines, bis-sulfonylmethanes, and the carbocyclic and heterocyclic derivatives of these compounds. These chemicals have the ability to form a soluble complex with silver ion and transport the silver out of the film into a receiving vehicle. The receiving vehicle can be another coated layer (laminate) or a conventional liquid processing bath.

The stabilization of the silver halide and silver donor can also be accomplished with a common stabilization chemical. The previously mentioned silver salt removal compounds can be employed in this regard. With stabilization, the silver is not necessarily removed from the film, although the fixing agent and stabilization agents could very well be a single chemical. The physical state of the stabilized silver is no longer in large (>50 nm) particles as it was for the silver halide and silver donor, so the stabilized state is also advantaged in that light scatter and overall density is lower, rendering the image more suitable for scanning.

The removal of the metallic silver is more difficult than removal of the silver halide and silver donor. In general, two reaction steps are involved. The first step is to bleach the metallic silver to silver ion. The second step may be identical to the removal/stabilization step(s) described for silver halide and silver donor above. Metallic silver is a stable state that does not compromise the archival stability of the PTG film. Therefore, if stabilization of the PTG film is favored over removal of silver, the bleach step can be skipped and the metallic silver left in the film. In cases where the metallic silver is removed, the bleach and fix steps can be done together (called a blix) or sequentially (bleach+fix).

The process could involve one or more of the scenarios or permutaions of steps. The steps can be done one right after another or can be delayed with respect to time and location. For instance, heat development and scanning can be done in a remote kiosk, then bleaching and fixing accomplished several days later at a retail photofinishing lab. In one embodiment, multiple scanning of images is accomplished. For example, an initial scan may be done for soft display or a lower cost hard display of the image after heat processing, then a higher quality or a higher cost secondary scan after stabilization is accomplished for archiving and printing, optionally based on a selection from the initial display.

For illustrative purposes, a non-exhaustive list of photothermographic film processes involving a common dry heat development step are as follows:

1. heat development=>scan=>stabilize (for example, with a laminate)=>scan=>obtain returnable archival film.
2. heat development=>fix bath=>water wash=>dry=>scan=>obtain returnable archival film
3. heat development=>scan=>blix bath=>dry=>scan=>recycle all or part of the silver in film
4. heat development=>bleach laminate=>fix laminate=>scan=>(recycle all or part of the silver in film)
5. heat development=>scan=>blix bath=>wash=>fix bath=>wash=>dry=>obtain returnable archival film
6. heat development=>relatively rapid, low quality scan
7. heat development=>bleach=>wash=>fix=>wash=>dry=>relatively slow, high quality scan Photothermographic or photographic elements of the present invention can also be subjected to low volume processing ("substantially dry" or "apparently dry") which is defined as photographic processing where the volume of applied developer solution is between about 0.1 to about 10 times, preferably about 0.5 to about 10 times, the volume of solution required to swell the photographic element. This processing may take place by a combination of solution application, external layer lamination, and heating. The low volume processing system may contain any of the elements described above for Type I: Photothermographic systems. In addition, it is specifically contemplated that any components described in the preceding sections that are not necessary for the formation or stability of latent image in the origination film element can be removed from the film element altogether and contacted at any time after exposure for the purpose of carrying out photographic processing, using the methods described below.

The Type II photothermographic element may receive some or all of the following three treatments:

(1) Application of a solution directly to the film by any means, including spray, inkjet, coating, gravure process and the like.

(II) Soaking of the film in a reservoir containing a processing solution. This process may also take the form of dipping or passing an element through a small cartridge.

(III) Lamination of an auxiliary processing element to the imaging element. The laminate may have the purpose of providing processing chemistry, removing spent chemistry, or transferring image information from the latent image recording film element. The transferred image may result from a dye, dye precursor, or silver containing compound being transferred in a imagewise manner to the auxiliary processing element.

Heating of the element during processing may be effected by any convenient means, including a simple hot plate, iron, roller, heated drum, microwave heating means, heated air, vapor, or the like. Heating may be accomplished before, during, after, or throughout any of the preceding treatments I–II. Heating may cause processing temperatures ranging from room temperature to 100 ° C.

Once yellow, magenta, and cyan dye image records (or the like) have been formed in the processed photographic elements of the invention, conventional techniques can be employed for retrieving the image information for each color record and manipulating the record for subsequent creation of a color balanced viewable image. For example, it is possible to scan the photothermographic element successively within the blue, green, and red regions of the spectrum or to incorporate blue, green, and red light within a single scanning beam that is divided and passed through blue, green, and red filters to form separate scanning beams for each color record. A simple technique is to scan the photothermographic element point-by-point along a series of laterally offset parallel scan paths. The intensity of light passing through the element at a scanning point is noted by a sensor which converts radiation received into an electrical signal. Most generally this electronic signal is further manipulated to form a useful electronic record of the image. For example, the electrical signal can be passed through an analog-to-digital converter and sent to a digital computer together with location information required for pixel (point) location within the image. In another embodiment, this electronic signal is encoded with calorimetric or tonal information to form an electronic record that is suitable to allow reconstruction of the image into viewable forms such as computer monitor displayed images, television images, printed images, and so forth.

It is contemplated that many of imaging elements of this invention will be scanned prior to the removal of silver halide from the element. The remaining silver halide yields a turbid coating, and it is found that improved scanned image quality for such a system can be obtained by the use of scanners that employ diffuse illumination optics. Any technique known in the art for producing diffuse illumination can be used. Preferred systems include reflective systems, that employ a diffusing cavity whose interior walls are specifically designed to produce a high degree of diffuse reflection, and transmissive systems, where diffusion of a beam of specular light is accomplished by the use of an optical element placed in the beam that serves to scatter light. Such elements can be either glass or plastic that either incorporate a component that produces the desired scattering, or have been given a surface treatment to promote the desired scattering.

One of the challenges encountered in producing images from information extracted by scanning is that the number of pixels of information available for viewing is only a fraction of that available from a comparable classical photographic print. It is, therefore, even more important in scan imaging to maximize the quality of the image information available. Enhancing image sharpness and minimizing the impact of aberrant pixel signals (i.e., noise) are common approaches to enhancing image quality. A conventional technique for minimizing the impact of aberrant pixel signals is to adjust each pixel density reading to a weighted average value by factoring in readings from adjacent pixels, closer adjacent pixels being weighted more heavily.

The elements of the invention can have density calibration patches derived from one or more patch areas on a portion of unexposed photographic recording material that was subjected to reference exposures, as described by Wheeler et al U.S. Pat. No. 5,649,260, Koeng at al U.S. Pat. No. 5,563,717, and by Cosgrove et al U.S. Pat. No. 5,644,647.

Illustrative systems of scan signal manipulation, including techniques for maximizing the quality of image records, are disclosed by Bayer U.S. Pat. No. 4,553,156; Urabe et al U.S. Pat. No. 4,591,923; Sasaki et al U.S. Pat. No. 4,631,578; Alkofer U.S. Pat. No. 4,654,722; Yamada et al U.S. Pat. No. 4,670,793, Klees U.S. Pat. Nos. 4,694,342 and 4,962,542; Powell U.S. Pat. No. 4,805,031; Mayne et al U.S. Pat. No. 4,829,370; Abdulwahab U.S. Pat. No. 4,839,721, Matsunawa et al U.S. Pat. Nos. 4,841,361 and 4,937,662, Mizukoshi et al U.S. Pat. No. 4,891,713; Petilli U.S. Pat. No. 4,912,569; Sullivan et al U.S. Pat. Nos. 4,920,501 and 5,070,413; Kimoto et al U.S. Pat. No. 4,929,979; Hirosawa et al U.S. Pat. No. 4,972,256; Kaplan U.S. Pat. No. 4,977,521; Sakai U.S. Pat. No. 4,979,027; Ng U.S. Pat. No. 5,003,494; Katayama et al U.S. Pat. No. 5,008,950; Kimura et al U.S. Pat. No. 5,065,255; Osarnu et al U.S. Pat. No. 5,051,842; Lee et al U.S. Pat. 5,012,333; Bowers et al U.S. Pat. No. 5,107,346; Telle U.S. Pat. No. 5,105,266; MacDonald et al U.S. Pat. No. 5,105,469; and Kwon et al U.S. Pat. No. 5,081,692. Techniques for color balance adjustments during scanning are disclosed by Moore et al U.S. Pat. No. 5,049,984 and Davis U.S. Pat. No. 5,541,645.

The digital color records once acquired are in most instances adjusted to produce a pleasingly color balanced image for viewing and to preserve the color fidelity of the image bearing signals through various transformations or renderings for outputting, either on a video monitor or when printed as a conventional color print. Preferred techniques for transforming image bearing signals after scanning are disclosed by Giorgianni et al U.S. Pat. No. 5,267,030, the disclosures of which are herein incorporated by reference. Further illustrations of the capability of those skilled in the art to manage color digital image information are provided by Giorgianni and Madden *Digital Color Management*, Addison-Wesley, 1998.

The following examples are included for a further understanding of this invention.

EXAMPLES

This Example illustrates the preparation of blank dispersions with incorporated ionic liquids. Several 200 g samples of dispersions listed in TABLE 1 below were prepared by adding a oil phase (50 C) of 16 g of dibutylsebecate (DBS) with 0.16 g IRGANOX 1076 to 184 g of aqueous phase (50 C) containing 16 g bone gelatin and 1.17 g of a nonionic surfactant of structure $C_{12}H_{25}$—S—$(CH_2CHCONH_2)_{10}$—H which is a member of the class of surfactants disclosed in commonly assigned EP 1,1 22,279A and copending U.S. Ser. No. 09/770,129 hereby incorporated by reference. A SILVERSON rotor-stator mixer provided agitation during the addition of the oil phase and the resulting dispersion was homogenized using a MICROFLUIDIZER mixer (3 passes at 3000 psi). The addition of ionic liquid to the oil phase was accompanied by an equal reduction in the amount of solvent. Ionic liquids, when present in the composition of TABLE 1, were 1-hexadecyl-3-methyl imidazolium tetrafluoroborate (IL-1) or 1-methyl-3-oleyl imidazolium tetrafluoroborate (IL-2).

IL-1

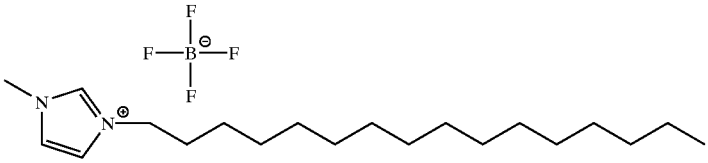

IL-2

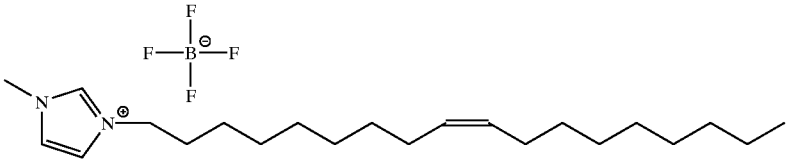

TABLE 1

| Sample | % DBS | Ionic Liquid (%) |
|---|---|---|
| 1a | 8 | 0 |
| 1b | 6 | IL-1(2) |
| 1c | 4 | IL-1(4) |
| 1d | 4 | IL-2(4) |

The ionic liquids 1-methyl-3-hexylimidazolium tetrafluoroborate (IL-3) 1 -methyl-3-octylimidazolium tetrafluoroborate (IL4) were also used in the preparation of coating examples. The ionic liquids IL-3 and IL4 were incorporated as either gelatin dispersions or 10% solutions in ethyl acetate. When incorporated as gelatin dispersions, the ionic liquids IL-3 and IL-4 were present at 5% (w/w) and the gel was 6%.

IL-3

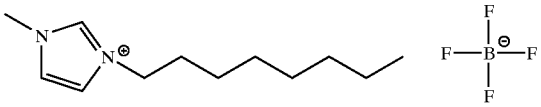

IL-4

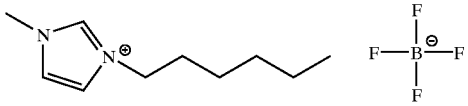

In addition to the above ionic liquid dispersions, the following additional components were also used in the preparation of photothermographic coating examples:

Developer Dispersion:

A slurry was milled in water containing developer D-1 and OLIN 10G as a surfactant. The OLIN 10G was added at a level of 10% by weight of the D-1. To the resulting slurry was added water and dry gelatin in order to bring the final concentrations to 13% D-17 and 4% gelatin. The gelatin was allowed to swell by mixing the components at 15° C. for 90 minutes. After this swelling process, the gelatin was dissolved by bringing the mixture to 40° C. for 10 minutes, followed by cooling to chill-set the dispersion.

D-1

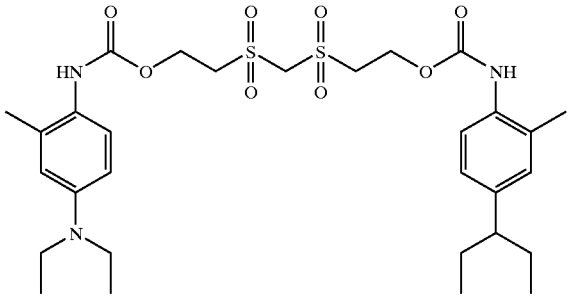

Couplers:

Couplers were incorporated into photographic coatings as conventional dispersions using a high-boiling organic liquid as solvent. Coupler M-1 was dispersed with 50% (w/w) of mixed tricresyl phosphates in aqueous gelatin. The final weight percent of the coupler in the dispersion was 5.5%. The gelatin content of the dispersion was 8.8%. Coupler Y-1 was dispersed with 50% (w/w) dibutylphthalate. The final weight percent of Y-1 in the dispersion was 5% and the gel was 8%. Coupler C-1 was dispersed with an equal weight of dibutyl sebacate. The final weight percent of coupler C-1 in its dispersion was 7.7%, and the gel percent was 8.8%.

M-1

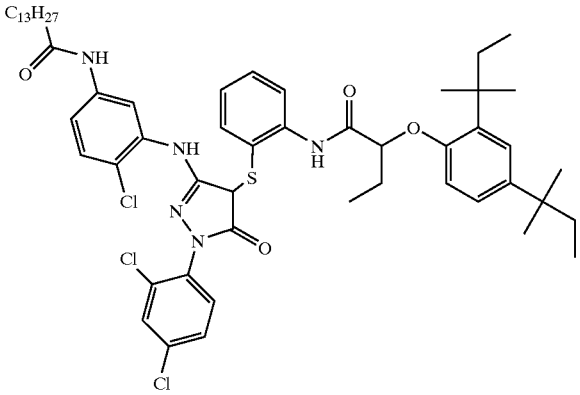

-continued

Coupler Y-1

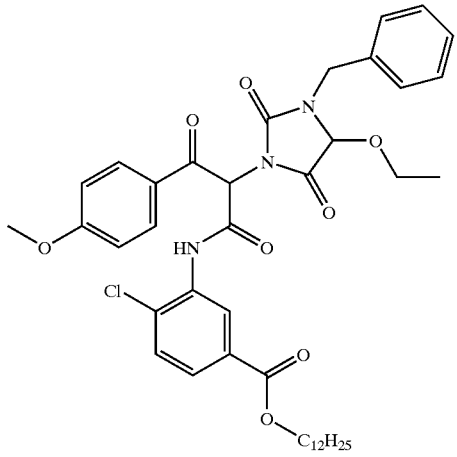

Coupler C-1

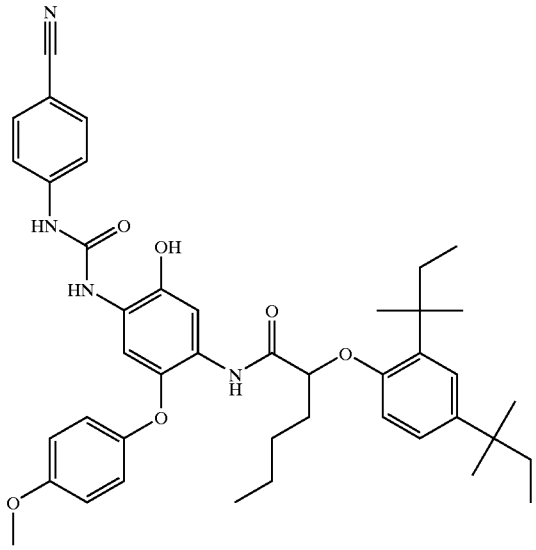

Melt former MF-1:

A dispersion of salicylanilide (MF-1) was media-milled to give a dispersion containing 30% salicylanilide, with 4% TRITON X-200 surfactant and 4% polyvinyl pyrrolidone added relative to the weight of salicylanifide. The dispersion was then diluted with water to provide a final salicylanilide concentration of 25%.

MF-1

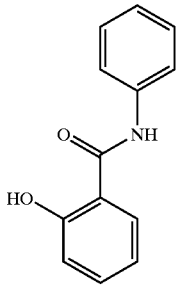

Silver salt dispersion SS-1:

A stirred reaction vessel was charged with 431 g of lime processed gelatin and 6569 g of distilled water. A solution containing 214 g of benzotriazole, 2150 g of distilled water, and 790 g of 2.5 molar sodium hydroxide was prepared (Solution B). The mixture in the reaction vessel was adjusted to a pAg of 7.25 and a pH of 8.00 by additions of Solution B, nitric acid, and sodium hydroxide as needed. A 4 l solution of 0.54 molar silver nitrate was added to the kettle at 250 cc/minute, and the pAg was maintained at 7.25 by a simultaneous addition of solution B. This process was continued until the silver nitrate solution was exhausted, at which point the mixture was concentrated by ultrafiltration. The resulting silver salt dispersion contained fine particles of silver benzotriazole.

Silver salt dispersion SS-2:

A stirred reaction vessel was charged with 431 g of lime processed gelatin and 6569 g of distilled water. A solution containing 320 g of 1-phenyl-5-mercaptotetrazole , 2044 g of distilled water, and 790 g of 2.5 molar sodium hydroxide was prepared (Solution B). The mixture in the reaction vessel was adjusted to a pAg of 7.25 and a pH of 8.00 by additions of Solution B, nitric acid, and sodium hydroxide as needed. A 4 l solution of 0.54 molar silver nitrate was added to the kettle at 250 cc/minute, and the pAg was maintained at 7.25 by a simultaneous addition of solution B. This process was continued until the silver nitrate solution was exhausted, at which point the mixture was concentrated by ultrafiltration. The resulting silver salt dispersion contained fine particles of the silver salt of 1-phenyl-5-mercaptotetrazole.

Emulsion E-1:

A silver halide tabular emulsion with a composition of 96% silver bromide and 4% silver iodide was prepared by conventional means. The resulting emulsion had an equivalent circular diameter of 1.2 microns and a thickness of 0.11 microns. This emulsion was spectrally sensitized to green light by addition of a combination of dyes SM-1 and SM-2 at a ratio of 4.5:1 and then chemically sensitized for optimum performance.

SM-1

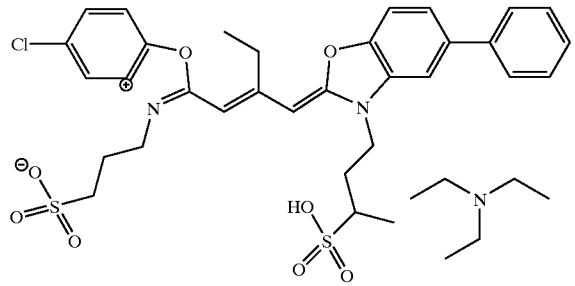

SM-2

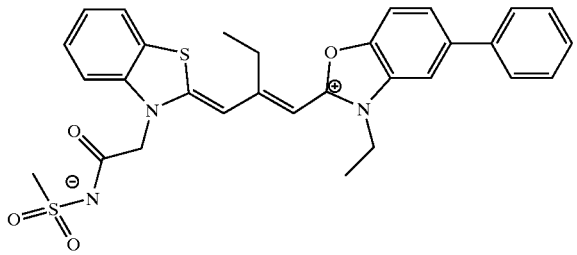

Emulsion E-2:

A silver halide tabular emulsion with a composition of 97% silver bromide and 3% silver iodide was prepared by conventional means. The resulting emulsion had an equivalent circular diameter of 0.41 microns and a thickness of 0.06 microns. This emulsion was spectrally sensitized to blue light by addition of dye SY-1 dye and then chemically sensitized for optimum performance.

SY-1

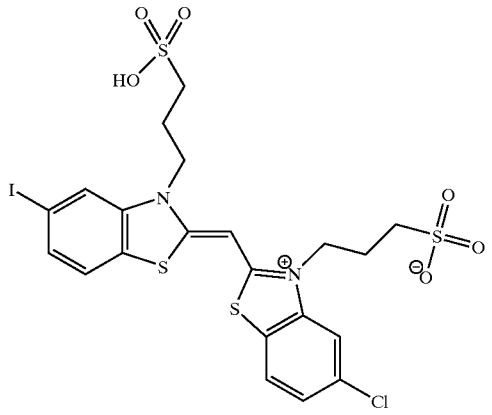

EXAMPLE 1

To demonstrate the benefit of incorporating ionic liquids as addenda with dye forming couplers, photothernographic handcoatings were prepared on 4 mil polyethyleneterephthalate (PET) support using the above components at levels (laydowns) given in TABLE 2.

TABLE 2

| | |
|---|---|
| Developer D-1 | 0.75 g/sq m for D-1 |
| Silver Salt SS-1 | 0.32 g Ag/sq m |
| Silver Salt SS-2 | 0.32 g Ag/sq m |
| Meltformer MF-1 | 0.86 g/sq m |
| Coupler M-1 | 0.53 g/sq m |
| Emulsion E-2 | 0.54 g Ag/sq m |
| Gelatin Binder | 4.30 g/sq m |

In addition, coating examples contained either IL-3 or IL-4 at zero, 0.11, 0.22, or 0.32 g/sq m, as detailed in TABLE 2. Following coating, the samples were exposed to a tungsten light source through a 0–3 step wedge, and then processed by heating for 20 seconds at 140° C. Following heat processing, the silver halide emulsion was removed from the coatings by fixing in a thiosulfate bath. The coatings were then read on an X-rite densitometer, and the minimum and maximum densities are reported in TABLE 3, showing sensitometric data for photothermographic coatings containing ionic liquids and coupler M-1.

TABLE 3

| Coating | Ionic Liquid (g/sq m) | Ionic Liquid Incorporation Method | Green D-min | Green D-max | Green Discrimination (Dmax-Dmin) |
|---|---|---|---|---|---|
| 1-1 | None | — | 0.06 | 0.22 | 0.16 |
| 1-2 | IL-3 (20) | Ethyl acetate | 0.19 | 0.69 | 0.50 |
| 1-3 | IL-3 (10) | Gel dispersion | 0.09 | 0.46 | 0.37 |
| 1-4 | IL-3 (20) | Gel dispersion | 0.14 | 0.63 | 0.49 |
| 1-5 | IL-3 (30) | Gel dispersion | 0.18 | 0.84 | 0.66 |
| 1-6 | IL-4 (20) | Ethyl acetate | 0.18 | 0.75 | 0.57 |
| 1-7 | IL-4 (10) | Gel dispersion | 0.19 | 0.54 | 0.35 |
| 1-8 | IL-4 (20) | Gel dispersion | 0.18 | 0.87 | 0.69 |
| 1-9 | IL-4 (30) | Gel dispersion | 0.40 | 1.31 | 0.91 |

A comparison of Coating 1—1 (no ionic liquid) with Coatings 1–2 through 1–9 (containing IL-3 or IL-4 at 10–30 mg/ft2) shows that the presence of an ionic liquid increases both D-min and D-max. Image discrimination (D-max minus D-min) is significantly improved for coatings that contain an ionic liquid, with higher levels of discrimination at higher levels of ionic liquid.

EXAMPLE2

Coatings were prepared identically to those in Example 1, with the exception that a dispersion of cyan coupler C-1 was used in place coupler M-1. The laydown of coupler C-1 was 0.65 g /m$^2$. The coatings were exposed and processed as described in Example 1, and the sensitometric results are reported in TABLE 4, showing sensitometric data for photothermographic coatings containing ionic liquids and coupler C-1.

TABLE 4

| Coating | Ionic Liquid (mg/ft$^2$) | Ionic Liquid Incorporatio n Method | Red D-min | Red D-max | Red Discrimination (Dmax-Dmin) |
|---|---|---|---|---|---|
| 2-1 | None | — | 0.07 | 0.08 | 0.01 |
| 2-2 | IL-3 (10) | Ethyl acetate | 0.13 | 0.45 | 0.32 |
| 2-3 | IL-3 (20) | Ethyl acetate | 0.12 | 0.37 | 0.25 |
| 2-4 | IL-3 (30) | Ethyl acetate | 0.21 | 0.61 | 0.4 |
| 2-5 | IL-4 (10) | Ethyl acetate | 0.16 | 0.33 | 0.17 |
| 2-6 | IL-4 (20) | Ethyl acetate | 0.23 | 0.42 | 0.19 |
| 2-7 | IL-4 (30) | Ethyl acetate | 0.33 | 0.59 | 0.26 |

As seen in these examples, the incorporation of an ionic liquid as an addenda in these photothermographic coatings substantially improved both the maximum red density and red discrimination of coupler C-1.

EXAMPLE 3

Photothermographic coatings were prepared similarly to those in Example 1, with the exception that the coupler Y-1 was used in place of M-1. The laydown of the coupler Y-1 in the coating examples was 0.64 g/m$^2$. The dispersions 1a–1d described above were also coated in the examples. The coatings of Example 3 additionally received an overcoat of 3.2 g/m$^2$ gelatin and were hardened with bis-vinylsulfonyl methane at 1.8% (w/w) of total gelatin. The coatings were exposed through a stepped exposure and subsequently processed by heating for 18 seconds at 161° C. Following processing, the light-sensitive silver halide was removed from the coatings by fixing in a sodium thiosulfate bath. The sensitometry was measured and the results are presented in TABLE 5.

TABLE 5

| Sample | Dispersion (IL) | Laydown of Ionic Liquid (g/sq m) | Blue Dmin | Blue Dmax | Discrimination Dmax-Dmin |
|---|---|---|---|---|---|
| 3-1 | 1a (none) | 0 | 0.07 | 0.67 | 0.60 |
| 3-2 | 1b (IL-1) | 0.05 | 0.09 | 0.98 | 0.89 |
| 3-3 | 1c (IL-1) | 0.11 | 0.10 | 1.12 | 1.02 |
| 3-4 | 1d (IL-2) | 0.11 | 0.10 | 1.11 | 1.01 |

As seen in these examples, the presence of an ionic liquid in these photothermographic coatings greatly improved the maximum blue density and image discrimination while having minimal impact on Dmin. The utility of ionic liquids as addenda in photothermographic coatings has thus been demonstrated with magenta, cyan, and yellow dye forming couplers.

The invention has been described in detail with particular reference to certain preferred embodiments thereof, but it will be understood that variations and modifications can be effected within the spirit and scope of the invention.

What is claimed is:

1. A photothermographic light-sensitive element comprising a support and, on said support, at least three light-sensitive color imaging layers which have their individual sensitivities in different wavelength regions, each of said imaging layers comprising a light-sensitive silver-halide emulsion, an organic silver salt, a binder, a dye-providing coupler, and a blocked developer, the dyes formed from the dye-providing couplers in the layers being different in hue, therefore capable of forming at least three dye images of different visible or infra-red colors, wherein the element further comprises an ionic liquid material in association with at least one imaging layer.

2. The photothermographic light-sensitive element of claim 1 wherein the ionic liquid material is dispersed in an organic solvent which forms droplets having a average diameter in the range of 0.1 to 20 microns.

3. The photothermographic light-sensitive element of claim 1 wherein the ionic liquid is in the form of solid particles at 25° C.

4. The phototothermographic light-sensitive element of claim 1 wherein the ionic liquid material is selected from the group consisting of imidazolium compounds, pyrazolium compounds, pyridinium compounds, pyrimidinium compounds, tetraalkyl ammonium compounds, tetraalkyl phosphonium compounds, and mixtures thereof.

5. The photothermographic light-sensitive element of claim 1 wherein the ionic liquid material is selected from the group consisting of:

(a) those of the formula

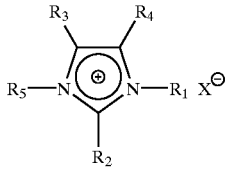

wherein $R_1$ and $R_5$ are independently an alkyl group and $R_2$, $R_3$, and $R_4$ each, independently of the others, are hydrogen atoms or alkyl groups;

(b) those of the formula

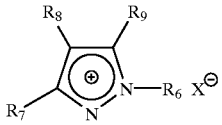

wherein $R_6$ is an alkyl group and $R_7$, $R_8$, and $R_9$ each, independently of the others, are hydrogen atoms or alkyl groups, and X is an anion, c) those of the formula:

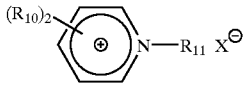

wherein $R_{11}$ is an alkyl group and each $R_{10}$ is independently a hydrogen atom or a substituted or unsubstituted alkyl group, and X is an anion, (d) those of the formula

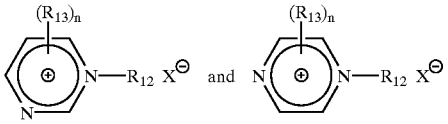

wherein $R_{12}$ is an alkyl group and each $R_{13}$ can be independently a hydrogen atom or substituted or unsubstituted alkyl group, n is 1 to 4, and X is an anion, and (e) those of the formulae:

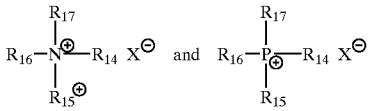

wherein $R^{14}$, $R^{15}$, $R^{16}$, and $R^{17}$ each, independently of the others, are alkyl groups, and X is an anion; and (f) mixtures thereof.

6. The photothermographic light-sensitive element of claim 1 wherein the ionic liquid material is selected front the group consisting, of 1,3-alkylimidazolium salts, N-alkyl pyridinium salts, and mixtures thereof.

7. The photothermographic light-sensitive element of claim 1 wherein the imaging layer and/or an adjacent layer contains the ionic liquid in an amount between about 0.1 and 50 mg/ft$^2$.

8. The photothermographic light-sensitive element of claim 1 wherein the imaging layer and/or an adjacent layer contains the ionic liquid in an amount between about 1 and 10 mg/ft$^2$.

9. The photothermographic light-sensitive element of claim 1 wherein the ionic liquid material is contained in droplets of a hydrophobic organic composition which also comprises an organic solvent.

10. The photothermographic light-sensitive element of claim 9 wherein the organic solvent is selected from the group consisting of phthalic ester compounds and phosphoric ester compounds.

11. The photothermographic light-sensitive element of claim 1 wherein the ionic liquid material has an anion selected from the group consisting of tetrafluoborate, nitrate, hexafluorophosphate, perchlorate, and mixtures thereof.

12. The photothermographic light-sensitive element of claim 1 wherein the ionic liquid material is selected from the group consisting of imidazoliun compounds, pyrazolium compounds, pyridinium compounds, pyrimidinium compounds, tetraalkyl ammonium compounds, tetraalkyl phosphonium compounds, and mixtures thereof and the ionic liquid material has an anion selected from the group consisting of tetrafluoborate, nitrate, hexafluorophosphate, perchlorate, and mixtures thereof.

13. A method of forming an image in a photothermographic light-sensitive element according to claim 1, which method comprises imagewise exposing said element to light-sensitive element to light, heating the element to a temperature of 80° C. to about 180° C., wherein the organic silver salt reacts with the silver halide in the presence of the ionic liquid material.

14. The method according to claim 13 wherein the ionic liquid material is selected from the group consisting of imidazolium compounds, pyrazolium compounds, pyridinium compounds, pyridinium compounds, tetraalkyl anmmonium compounds, tetraalkyl phosphonium compounds, and mixtures thereof.

15. The method according to claim 13 wherein the imaging layer contains the ionic liquid material in an amount between about 0.1 and 50 $ft^2$.

16. An emulsion for use in a silver halide color or monochrome photothermographic light-sensitive element, said emulsion comprising silver-halide, organic silver salt, an incorporated developing agent or precursor thereof, a dye-forming coupler, and an ionic liquid material.

* * * * *